US006715513B2

(12) United States Patent
Landolt et al.

(10) Patent No.: US 6,715,513 B2
(45) Date of Patent: Apr. 6, 2004

(54) APPARATUS AND METHOD FOR WIRE HARNESS ASSEMBLY

(75) Inventors: Robert G. Landolt, Joplin, MO (US); William B. Layton, Diamond, MO (US)

(73) Assignee: LaBarge, Inc., St. Louis, MO (US)

( * ) Notice: Subject to any disclaimer, the term of this patent is extended or adjusted under 35 U.S.C. 154(b) by 0 days.

(21) Appl. No.: 10/162,443

(22) Filed: Jun. 4, 2002

(65) Prior Publication Data

US 2003/0221743 A1 Dec. 4, 2003

(51) Int. Cl.[7] ..... B21F 27/12
(52) U.S. Cl. ..... 140/92.1; 29/755
(58) Field of Search ..... 29/721, 755; 140/92.1

(56) References Cited

U.S. PATENT DOCUMENTS 3,169,305 A * 2/1965 Gray ..... 29/721
3,216,101 A * 11/1965 Miller ..... 29/755
3,346,020 A 10/1967 Geisinger ..... 140/92.1
3,653,411 A 4/1972 Mosher et al. ..... 140/92.1
4,483,373 A 11/1984 Tarbox ..... 140/92.1
4,979,544 A * 12/1990 Swindlehurst ..... 140/92.1

* cited by examiner

*Primary Examiner*—Lowell A. Larson
(74) *Attorney, Agent, or Firm*—William R. Sharp

(57) ABSTRACT

An apparatus and method for wire harness assembly employ a formboard with a plurality of holes and a plurality of layout sheets having respective free edges and opposing attached edges that are attached to the formboard so as to be aligned with and stacked upon one another. Each layout sheet also has a harness pattern thereon and a plurality of holes corresponding to holes in the formboard. One of the layout sheets can be selected to expose its harness pattern. The other unselected layout sheets comprise either or both of (i) at least one layout sheet under the selected layout sheet, and (ii) at least one layout sheet folded back from the selected layout sheet along the attached edge thereof. A plurality of guide pins can be inserted through respective holes in the selected layout sheet adjacent to its harness pattern, through respective holes in any unselected layout sheet under the selected layout sheet, and into corresponding holes in the formboard so as to be removably secured therein.

20 Claims, 3 Drawing Sheets

APPARATUS AND METHOD FOR WIRE HARNESS ASSEMBLY

BACKGROUND OF THE INVENTION

The invention relates to an apparatus for use in wire harness assembly, as well as a method of preparing a formboard for assembly of a wire harness.

Conventional assembly of a wire harness employs a formboard, a layout sheet having a harness pattern thereon, and guide pins that are permanently affixed to the formboard adjacent to the harness pattern. Most typically, the formboard is a sheet of plywood, and the guide pins are nails driven into the formboard and through the layout sheet at preselected locations. Accordingly, multiple formboards are required to assemble different wire harnesses. Significant storage space is needed for the multiple formboards, and the assembly worker must manually move the large and heavy formboards into and out of storage when changing from one harness type to another. This changeover operation is time consuming and raises safety concerns.

SUMMARY OF THE INVENTION

It is, therefore, an object of the invention to provide an apparatus and method for wire harness assembly which minimizes required storage space as well as the time and labor in changing harness patterns, thereby also optimizing safety.

According to one aspect of the invention, there is provided an apparatus for use in wire harness assembly, comprising: a formboard having a face and a plurality of holes through the face; a plurality of layout sheets, each layout sheet having a harness pattern thereon, a plurality of holes corresponding to holes in the formboard, a free edge, and an opposing attached edge that is attached to the formboard, wherein the attached edges of the layout sheets are aligned with and stacked upon one another to permit selection of one layout sheet, hereafter referred to as the selected layout sheet, lying over the face of the formboard with its harness pattern exposed, the other unselected layout sheets comprising either or both of (i) at least one layout sheet under the selected layout sheet, and (ii) at least one layout sheet folded back from the selected layout sheet along the attached edge thereof; and a plurality of guide pins, each guide pin being adapted to extend through a hole in the selected layout sheet adjacent to its harness pattern, through a hole in any unselected layout sheet under the selected layout sheet, and into a corresponding hole in the formboard so as to be removably secured therein.

According to another aspect of the invention, there is provided a method of preparing a formboard for assembly of a wire harness, the formboard having a face and a plurality of holes through the face, wherein the method comprises: providing a plurality of layout sheets, each layout sheet having a harness pattern thereon, a plurality of holes corresponding to holes in the formboard, a free edge, and an opposing attached edge that is attached to the formboard, wherein the attached edges of the layout sheets are aligned with and stacked upon one another; selecting one of the layout sheets for wire harness assembly, the thus selected layout sheet lying over the face of the formboard with its harness pattern exposed, and the other unselected layout sheets comprising either or both of (i) at least one layout sheet under the selected layout sheet, and (ii) at least one layout sheet folded back from the selected layout sheet along the attached edge thereof; and inserting a plurality of guide pins through respective holes in the selected layout sheet adjacent to its harness pattern, through respective holes in any unselected layout sheet under the selected layout sheet, and into holes in the formboard, corresponding to said respective holes in the selected layout sheet and any unselected layout sheet thereunder, so as to be removably secured therein.

Therefore, in accordance with the invention, multiple layout sheets with corresponding harness patterns are attached to a single formboard so as to minimize space requirements. Changing from one layout sheet to another involves simply removing any guide pins that were left in the formboard from a prior assembly, selecting the layout sheet having the desired harness pattern, and, with unselected layout sheets lying under and/or folded back from the selected sheet as described above, inserting guide pins adjacent to the newly selected harness pattern. The changeover operation requires minimal time and labor and is obviously very safe.

In a preferred embodiment hereafter described, any unselected layout sheet(s) folded back from the selected layout sheet is/are received in a holding tube, fixedly connected to the formboard adjacent to the attached edges of the layout sheets, so as to be held inside of the tube. Other preferred features include guide pins having tapered portions for being removably secured within tapered holes in the formboard, and a frame upon which the formboard is mounted for upward and downward movement by means of a motor and a mechanical linkage between the motor and formboard.

DETAILED DESCRIPTION OF THE INVENTION

Figure 1:
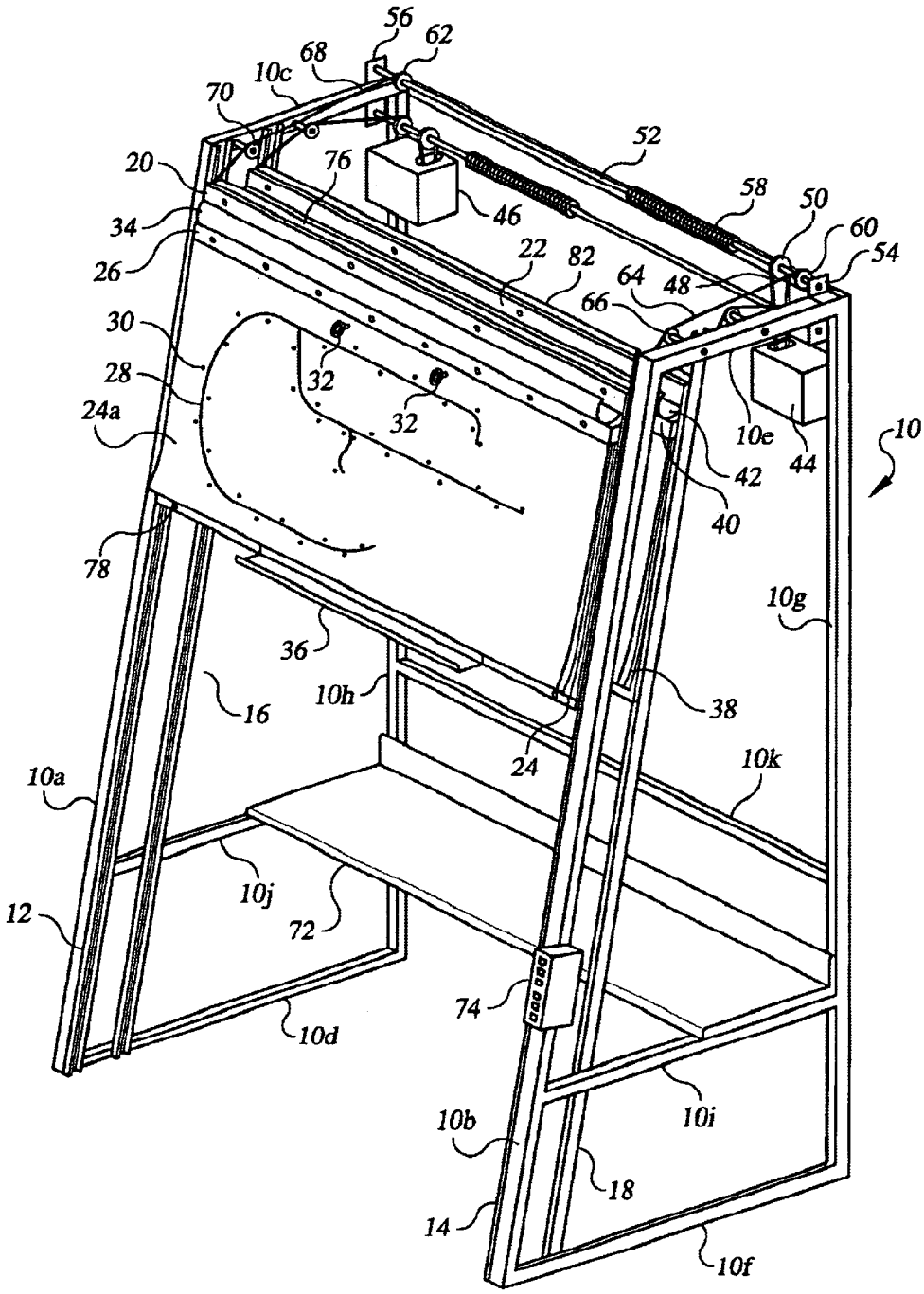
FIG. 1 is a perspective view of an apparatus in accordance with a preferred embodiment of the invention.

Referring to FIG. 1, the illustrated apparatus includes a frame 10 which includes a plurality of interconnected bars, preferably of a sturdy metallic construction. Opposing and slanted bars 10*a* and 10*b* have tracks 12 and 14 fixedly connected thereto, respectively, along their entire lengths. Tracks 16 and 18 are mounted to frame 10 to the rear of and parallel to tracks 12 and 14. Track 16 is connected between horizontal upper bar 10*c* and horizontal lower bar 10*d*. Similarly, track 18 is connected between horizontal upper bar 10*e* and horizontal lower bar 10*f*. A front formboard 20 is mounted to frame 10 for upward and downward movement along tracks 12 and 14, and a back formboard 22 (of which only a portion is visible) is mounted to frame 10 for upward and downward movement along tracks 16 and 18. This feature will be more fully explained with reference to FIG. 2. The apparatus can have only one formboard, but preferably has the second formboard to double the capacity of the apparatus while requiring very little additional space. Of course, the apparatus could be adapted to have more than two formboards.

A plurality of layout sheets 24 (i.e. 10–30) lie over the front face of formboard 20 and have their upper edges attached to formboard 20 by means of an overlying attachment strip 26 fixedly connected to formboard 20 with any suitable fasteners (i.e. bolts and associated nuts). The attached upper edges of layout sheets 24 are aligned with and stacked upon one another, and each such layout sheet also has an opposing lower free edge. Each of layout sheets 24 has a harness pattern thereon and a plurality of holes adjacent to the harness pattern. The illustrated top layout sheet 24*a* has a harness pattern 28 and a plurality of holes 30 adjacent thereto. A pair of eyes 32, of eyebolts secured to formboard 20, are received through slits in layout sheets 24 immediately below attachment strip 26. A slotted tube 34 is fixedly connected to formboard 20 adjacent to and immediately above attachment strip 26 and the attached upper edges of layout sheets 24. Tube 34, as well as eyes 32, will be more fully discussed with reference to FIGS. 4 and 5. A tray 36 is preferably mounted near the lower edge of formboard 20 for the purpose of holding various assembly parts, guide pins, etc. Formboard 22 is like formboard 20 insofar as having associated layout sheets 38, attachment strip 40, slotted tube 42, as well as eyes and a tray which are not visible in FIG. 1.

Figure 2:
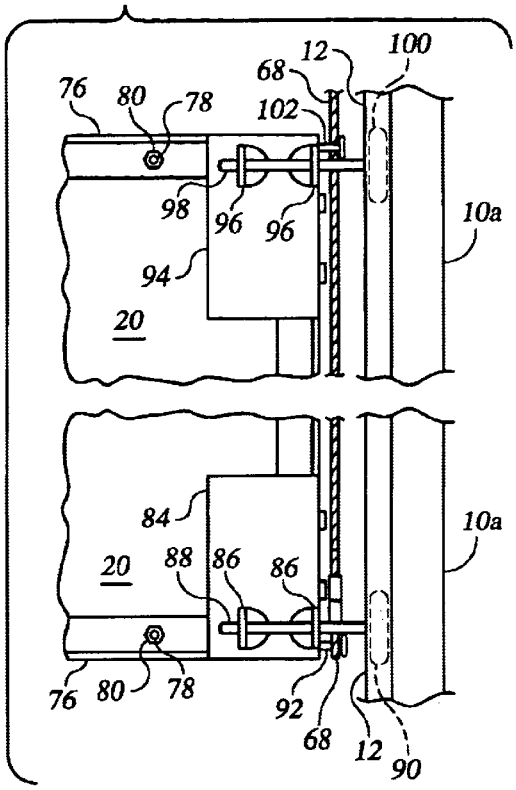
FIG. 2 is a fragmentary rear view of a formboard and the manner in which the formboard is movably mounted to a frame.

Drive motors 44 and 46, as respectively and fixedly mounted to vertical bars 10*g* and 10*h*, are mechanically linked to formboards 20 and 22 to allow the drive motors to either raise or lower the formboards. With regard to the mechanical linkage between motor 44 and formboard 20, an endless chain 48 extends from and is rotatable in either direction by motor 44. Chain 48 is received around a sprocket gear 50, which is fixedly mounted to a drive shaft 52. Drive shaft 52 extends between and is rotatably mounted to brackets 54 and 56, as are respectively and fixedly mounted to bars 10*e* and 10*c*. A torsion spring 58 is connected to drive shaft 52 in a manner to bias drive shaft 52 in a clockwise rotational direction. Pulleys 60 and 62 are fixedly mounted to drive shaft 52 near opposite ends thereof. A cable 64 is connected to pulley 60 and extends over pulley 66, which is rotatably mounted to bar 10*e*. Similarly, cable 68 is connected to pulley 62 and extends over pulley 70, which is rotatably mounted to bar 10*c*. Cables 64 and 68 are connected to formboard 20 on opposite sides thereof, as will be explained further below in regard to cable 64 as shown in FIG. 2. The mechanical linkage between drive motor 46 and formboard 22 is substantially similar to that described above and is shown in FIG. 1 (with one pulley obscured by bar 10*e*) without individual components being labeled with reference numbers.

Figure 3:
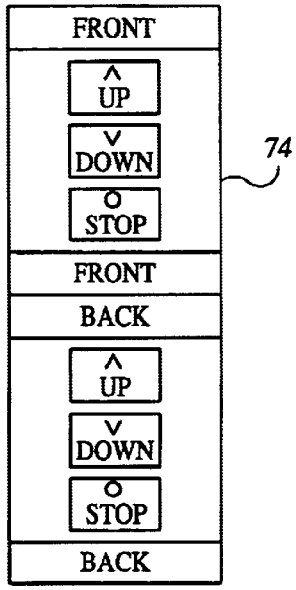
FIG. 3 is a close-up view of a control box shown in FIG. 1.

Motors 44 and 46 preferably have associated brakes for securely holding formboards 20 and 22 in their desired vertical positions, such as the uppermost positions shown in FIG. 1. In such uppermost positions, a workbench 72 mounted inside frame 10 is accessible by an assembly worker for preliminary assembly tasks. As shown, workbench 72 extends between and is mounted to horizontal bars 10*i* and 10*j*. Providing a workbench inside the frame in this manner saves considerable floor space. Horizontal bar 10*k*, extending between vertical bars 10*g* and 10*h* above and closely adjacent to workbench 72, can be employed for attachment of parts bins (not shown) thereto if desired. Finally with reference to FIG. 1, control box 74 is fixedly mounted to bar 10*b*. Control box 74, as will be further discussed with reference to FIG. 3, is used by the assembly worker for controlling motors 44 and 46 so as to selectively raise, lower, or stop either of the formboards. For the sake of simplicity, wiring between control box 74 and the motors is not shown in the drawings.

Referring to FIG. 2, this fragmentary rear view of formboard 20 shows the upper and lower corners on one side of the formboard. Subframe 76, preferably comprised of angle iron, abuts the rear face of formboard 20 around the perimeter thereof, and is fixedly secured to the formboard by any suitable means, such as bolts 78 and associated nuts 80. Although not shown in the drawings, a central cross brace preferably extends between the upper and lower portions of subframe 76. The upper portion of subframe 76 and the heads of bolts 78, adjacent to the upper and lower edges of formboard 20, are visible in FIG. 1. The subframe for formboard 22 is also indicated at 82 in FIG. 1.

Referring again to FIG. 2, bracket 84 is fixedly connected to subframe 76 at the lower corner thereof with, for example, a pair of bolts. Flanges 86 extend outwardly from bracket 84, and have holes for receiving a shaft 88 therethrough. A roller 90 (indicated by broken lines) is mounted on the end of shaft 88 so as to be received in track 12, which is fixedly connected to bar 10*a* as previously discussed. Roller 90 is rotatable to thereby be adapted for upward or downward movement along track 12. Cable 68 is securely looped around a stud 92 extending from the side of bracket 84. Bracket 94, as fixedly connected to subframe 76 at the upper corner thereof, has flanges 96 for receiving a shaft 98 upon which roller 100 (indicated by broken lines) is mounted for rotatable upward or downward movement in track 12. Cable 68 is received over but not connected to a stud 102 extending from the side of bracket 94. Of course, the other side of formboard 20, as well as both sides of formboard 22, are similarly mounted for upward or downward movement along their corresponding tracks.

Referring now to FIG. 3, control box 74 is divided into front and back sections, clearly marked as shown. The buttons in the front section are for controlling the front formboard 20, and the buttons in the back section are for controlling the back formboard 22. Each "up" button can be pressed and released to cause upward movement of the corresponding formboard. Upward movement continues until the formboard reaches its uppermost position, or the formboard can be stopped before reaching the uppermost position by pressing the "stop" button. Each "down" button can be pressed to cause downward movement of the corresponding formboard. Such downward movement continues only so long as the "down" button is pressed. Release of the "down" button causes the formboard to stop. This is a desirable safety feature, since this substantially assures that the assembly worker cannot be under the formboard when it is moving downward.

Figure 4:
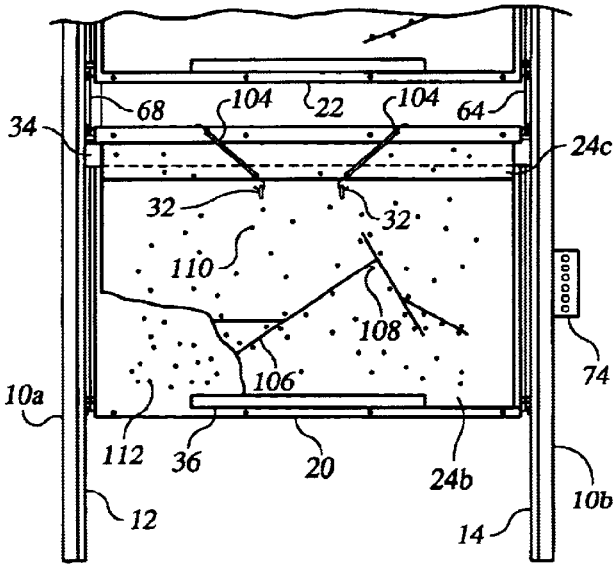
FIG. 4 is a front view of a portion of the apparatus showing a selected layout sheet, with its harness pattern exposed, and unselected layout sheets folded back from the selected sheet.

Referring now to FIG. 4, formboard 20 is shown after having been lowered to a position suitable for assembly of a wire harness. It should be noted that formboard 20 can be positioned by the assembly worker, using control box 74, to that vertical position most comfortable for assembly of the harness while the worker is either standing or sitting. This is an ergonomic advantage of the invention. Only a lower portion of formboard 22, as in its uppermost position, is shown in FIG. 4.

A layout sheet 24*b* has been selected for assembly of a wire harness. Some of the unselected layout sheets are under selected layout sheet 24*b*, and are not visible in FIG. 4. The other unselected layout sheets, as indicated at 24*c*, are folded back from selected layout sheet 24*b* along the attached edge thereof, and are received inside of tube 34 in a manner which will be more apparent with reference to FIG. 5. A pair of elastic cords 104 are employed to hold unselected layout sheets 24*c* in the illustrated position as folded back from selected layout sheet 24*b*. Each cord 104 has opposing hooks, of which one hook is received through and releasably secured to an eye 32, and the other hook is releasably secured to the upper portion of subframe 76 (FIG. 2). Selected layout sheet 24*b* has a harness pattern 106 thereon, and a plurality of holes 108 adjacent to the harness pattern. Other holes 110 are not adjacent to the harness pattern, and correspond to holes in unselected layout sheets 24*c*. Of course, holes 110 are positioned to avoid any interference with harness pattern 106. A CAD (computer assisting drafting) program can be particularly useful in preparing the various layout sheets to avoid such interference. A portion of selected layout sheet 24*b* and those unselected sheets thereunder have been broken away to reveal the underlying front face of formboard 20. Formboard 20 has a plurality of holes 112 through the front face corresponding to holes in the plurality of layout sheets 24. Moreover, holes 112 in formboard 20 include only holes corresponding to holes in layout sheets 24, such that holes 112 are irregularly spaced and are not required to follow any predetermined grid pattern.

Figure 5:
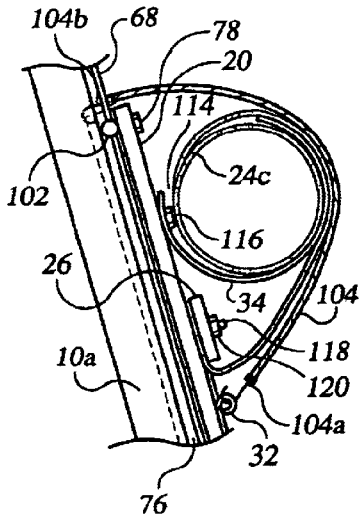
FIG. 5 is an enlarged fragmentary side view showing a tube connected to the formboard and unselected layout sheets as folded back and received in the tube.

Referring now to FIG. 5, this view shows the manner in which unselected layout sheets 24*c* are received in and held by tube 34. Tube 34 can be comprised of any suitable material, such as polyvinyl chloride (PVC). It should be apparent from FIG. 5, in conjunction with FIGS. 1 and 4, that the longitudinal axis of tube 34 is substantially parallel to the front face of formboard 20. Tube 34 has a longitudinally extending slot 114 that faces generally upwardly. Slot 114 should be wide enough (i.e. 2.5–3 inches for a 4 inch diameter tube) to easily receive unselected layout sheets 24*c* after having been rolled up. The thus formed roll of unselected layout sheets 24*c* are shown inside of tube 34 in FIG. 5, with elastic cord 104 securely holding such unselected sheets in this position. As shown, cord 104 has a hook 104*a* at one end received through eye 32, and a second hook 104*b* received by the upper portion of subframe 76. A portion of hook 104*b* is indicated by a broken line to be received under the edge of the angle iron that forms the upper portion of subframe 76. The rear edge of the angle iron that forms one side of subframe 76 is also indicated by a broken line. Tube 34 is fixedly connected to formboard 20 by bolts and associated nuts as spaced along the length of tube 34. The head of one such bolt is indicated at 116. FIG. 5 also shows the head of a bolt 78, securing formboard 20 to subframe 76, as well as the end of a bolt 118 and associated nut 120 for securing attachment strip 26 to formboard 20.

As should be clear from the above discussion with reference to FIGS. 4 and 5, selecting a layout sheet for wire harness assembly and folding back unselected layout sheets for being received in the illustrated slotted tube is a simple and quick operation, thus enhancing productivity.

Figure 6:
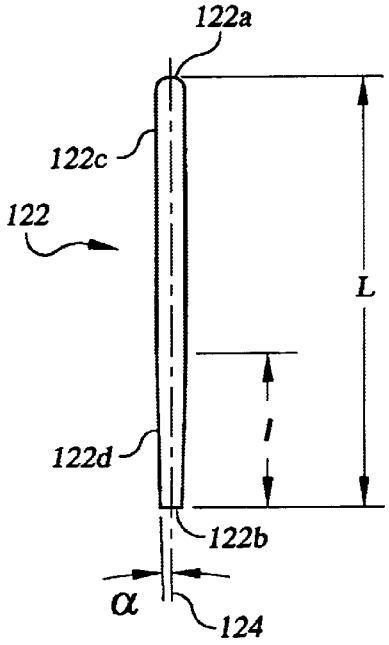
FIG. 6 illustrates a guide pin.

Referring now to FIG. 6, the illustrated guide pin 122 has opposing ends 122*a* and 122*b*, a straight portion 122*c*, and a tapered portion 122*d*. Straight portion 122*c* extends from end 122*a* to tapered portion 122*d* and is of uniform diameter along its length. Tapered portion 122*d* extends to end 122*b* so as to taper in diameter between straight portion 122*c* and end 122*b*. Guide pin 122 has a longitudinal axis 124. AS shown, tapered portion 122*d* has an exterior surface which defines an acute angle $\alpha$ with respect to longitudinal axis 124. Angle $\alpha$ is preferably less than 5°, more preferably about 1–2°, and most preferably about 1.5°. The overall length L is preferably about 2.5–3 inches, and the length 1 of tapered portion 122*d* is preferably about 0.75–1.25 inch. It is preferred that the length of tapered portion 122*d* is less than the length of straight portion 122*c*.

Figure 7:
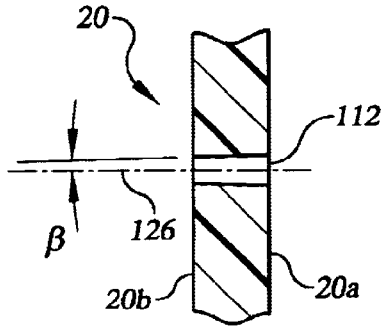
FIG. 7 is a fragmentary cross-sectional view of the formboard and a hole extending therethrough.

Referring now to FIG. 7, this cross-sectional view shows a hole 112 in formboard 20. Hole 112 preferably extends completely through formboard 20 so as to taper in diameter from front face 20*a* to rear face 20*b*. Hole 112 has a longitudinal axis 126 substantially perpendicular to front and rear faces 20*a* and 20*b*, which are substantially parallel to one another. As shown, hole 112 is circumscribed by an interior surface which defines an acute angle $\beta$ with respect to longitudinal axis 126. It is preferred that angle $\beta$ is substantially equivalent to angle $\alpha$ (FIG. 6).

Figure 8:
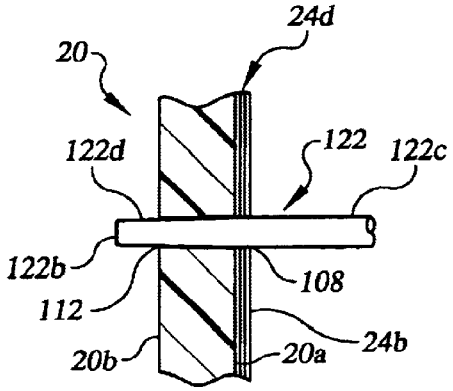
FIG. 8 is a fragmentary cross-sectional view showing a pin as received through a hole in the selected layout sheet, through holes in unselected layout sheets under the selected sheet, and into the above-mentioned hole in the formboard so as to be fixedly secured therein.

Referring now to FIG. 8, this cross-sectional view shows guide pin 122 extending through a hole 108 in selected layout sheet 24*b*, through aligned holes in unselected layout sheets 24*d* under selected layout sheet 24*b*, and into corresponding hole 112 in formboard 20 so that tapered portion 122*d* is securely but removably received therein. It is preferred that the thickness of formboard 20 (and thus the length of hole 112) is less than or equal to the length of tapered portion 122*d*, the diameter of hole 112 at front face 20*a* is less than or equal to the diameter of straight portion 122*c*, and the diameter of hole 112 at rear face 20*b* is greater than or equal to the diameter of end 122*b*, such that hole 112 receives tapered portion 122*d* with the exterior surface thereof in snug contact with the interior surface circumscribing hole 112 from front face 20*a* to rear face 20*b*. Most preferably, and as shown, the thickness of formboard 20 is less than the length of tapered portion 122*d*, the diameter of hole 112 at front face 20*a* is less than the diameter of straight portion 122*c*, and the diameter of hole 112 at rear face 20*b* is greater than the diameter of end 122*b*, such that part of tapered portion 122*d* adjacent to end 122*b* extends from rear face 20*b* outside of hole 112 and part of tapered portion 122*d* adjacent to straight portion 122*c* extends from front face 20*a* outside of hole 112. This provides optimum securement of tapered portion 122*d* in hole 112, even if hole 112 was to become slightly enlarged from wear and tear after repeated and numerous insertions and removals of guide pin 122.

An example of some preferred dimensions for formboard 20 and guide pin 122 will now be given for illustrative purposes, but which should not be construed to limit the invention in any manner: thickness of formboard 20—0.5 inch; diameter of hole 112 at front face 20*a*—0.1744 inch; diameter of hole 112 at rear face 20*b*—0.1482 inch; length of tapered portion 122*d*—1 inch; diameter of end 122*b*—0.1351 inch; and diameter of straight portion 122*c*—0.1875 inch. Angles $\alpha$ and $\beta$ are equal at 1.5°. Assuming the above-mentioned parameters, where tapered portion 122*d* of guide pin 122 is secured in hole 112, about 0.25 inch of tapered portion 122*d* adjacent end 122*b* extends outside of hole 112, and about 0.25 inch of tapered portion 122*d* adjacent straight portion 122*c* extends outside of hole 112.

Figure 9:
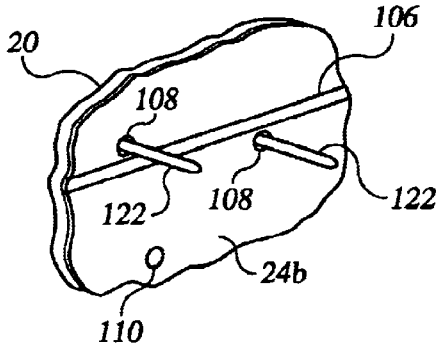
FIG. 9 is a is fragmentary view of the formboard and the overlying selected layout sheet with guide pins secured to the formboard and received through holes in the selected sheet adjacent to its harness pattern.

Referring to FIG. 9, this perspective view of a small portion of formboard 20 and overlying selected layout sheet

24*b* shows a portion of harness pattern 106 and two holes 108 adjacent to the harness pattern, as well as a hole 110 not adjacent to the harness pattern. Guide pins 122 are received through holes 108 so as to be removably secured in corresponding holes in formboard 20, in the manner previously discussed. Additional guide pins 122 are similarly received through the other holes 108 (shown in FIG. 4) adjacent to harness pattern 106 in preparation for assembly of a wire harness. AS shown in FIG. 9, each hole 108 is preferably slightly larger in diameter than the straight portion of guide pin 122.

With regard to the material of construction for the formboard, it is preferably comprised of a single layer of plastic that is substantially rigid, thermally stable, machinable, and readily capable of frictionally and securely engaging the exterior surface of the tapered portion of a guide pin as received in a hole in the formboard. Polypropylene is particularly preferred due to its moderate expense and commercial availability in sheet form. Alternative plastics include, for example, polytetrafluoro ethylene and low density polyethylene.

The material for the guide pin is preferably a machinable metal that is very rigid to resist bending, but sufficiently soft to minimize scratching of connectors and backshells (casings for protecting termination points) used in assembly of the harness. Aluminum is particularly preferred. Brass is one example of an alternative metal.

The combination of a guide pin having a tapered portion and a tapered hole in the formboard for securely but removably receiving the tapered portion provides a simple but highly effective means for manually inserting the guide pin into a preselected location on the formboard. The guide pin is held securely and rigidly in place, but can be easily removed from the formboard. Moreover, using preferred materials discussed above, a guide pin can be inserted into and removed from a hole in the formboard many times without appreciable wear to the interior surface circumscribing the hole.

Obviously, many modifications and variations of the present invention are possible in light of the above teachings. For example, according to broad aspects of the invention, some means other than the slotted tube (such as longitudinally spaced split rings) could be used to hold any unselected layout sheet(s) folded back from the selected layout sheet. Or, the apparatus could be modified to include optional features such as lighting fixtures and/or hardware to hold various tools for convenient use in wire harness assembly. It is, therefore, to be understood that the invention can be practiced otherwise than as specifically described.

That which is claimed is:

1. An apparatus for use in wire harness assembly, comprising:

a formboard having a face and a plurality of holes through the face;

a plurality of layout sheets, each layout sheet having a harness pattern thereon, a plurality of holes corresponding to holes in the formboard, a free edge, and an opposing attached edge that is attached to the formboard, wherein the attached edges of the layout sheets are aligned with and stacked upon one another to permit selection of one layout sheet, hereafter referred to as the selected layout sheet, lying over the face of the formboard with its harness pattern exposed, the other unselected layout sheets comprising either or both of (i) at least one layout sheet under the selected layout sheet, and (ii) at least one layout sheet folded back from the selected layout sheet along the attached edge thereof; and a plurality of guide pins, each guide pin being adapted to extend through a hole in the selected layout sheet adjacent to its harness pattern, through a hole in any unselected layout sheet under the selected layout sheet, and into a corresponding hole in the formboard so as to be removably secured therein.

2. An apparatus as recited in claim 1 further comprising a holding means, fixedly connected to the formboard adjacent to the attached edges of the layout sheets, for holding any unselected layout sheet folded back from the selected layout sheet.

3. An apparatus as recited in claim 2 wherein the holding means comprises a tube having a longitudinal axis, substantially parallel to the face of the formboard, and a longitudinally extending slot through which any unselected layout sheet folded back from the selected layout sheet can be received so as to be held inside of the tube.

4. An apparatus as recited in claim 3 wherein the attached edges and free edges of the layout sheets are oriented as upper and lower edges, respectively, the tube is fixedly connected to the formboard immediately above the attached edges, and the slot faces generally upwardly.

5. An apparatus as recited in claim 1 wherein each pin has opposing ends, a straight portion, and a tapered portion, the straight portion extending from one end to the tapered portion and being of uniform diameter along its length, and the tapered portion extending to the other end so as to taper in diameter between the straight portion and said other end.

6. An apparatus as recited in claim 5 wherein said aforementioned face of the formboard is hereafter denoted as the front face, the formboard also having an opposing rear face substantially parallel to the front face, and wherein each hole in the formboard extends completely therethrough so as to taper in diameter from the front face to the rear face to thereby be adapted to securely but removably receive the tapered portion of a pin.

7. An apparatus as recited in claim 6 wherein each pin has a longitudinal axis and each hole in the formboard has a longitudinal axis substantially perpendicular to the front and rear faces, the tapered portion of each pin having an exterior surface which defines an acute angle $\alpha$ with respect to the longitudinal axis of the pin, and each hole in the formboard being circumscribed by an interior surface therein which defines an acute angle $\beta$ with respect to the longitudinal axis of the hole, angles $\alpha$ and $\beta$ being substantially equivalent.

8. An apparatus as recited in claim 7 wherein the thickness of the formboard and the equivalent length of each hole in the formboard is less than or equal to the length of the tapered portion of each pin, the diameter of each hole in the formboard at the front face thereof is less than or equal to the diameter of the straight portion of each pin, and the diameter of each hole in the formboard at the rear face thereof is greater than or equal to the diameter of said other end of each pin at which the tapered portion terminates, such that each hole in the formboard is adapted to receive the tapered portion of a pin with the exterior surface thereof in snug contact with the interior surface circumscribing the hole from the front face to the rear face of the formboard.

9. An apparatus as recited in claim 1 wherein the attached edges and free edges of the layout sheets are oriented as upper and lower edges, respectively, and wherein the apparatus further comprises: a frame upon which the formboard is mounted for upward or downward movement; a drive motor fixedly mounted to the frame; a mechanical linkage between the drive motor and formboard which allows the drive motor to either raise or lower the formboard.

10. An apparatus as recited in claim 9 further comprising a control means for controlling the motor so as to selectively raise, lower, or stop the formboard.

11. An apparatus as recited in claim 10 further comprising a workbench mounted inside the frame which is accessible and useable when the formboard is in an uppermost position.

12. An apparatus as recited in claim 1 wherein the formboard is comprised of a plastic and each pin is comprised of a metal.

13. An apparatus as recited in claim 12 wherein the plastic is polypropylene and metal is aluminum.

14. An apparatus as recited in claim 1 wherein the formboard has only holes corresponding to the holes in the plurality of layout sheets, such that the holes in the formboard are irregularly spaced.

15. A method of preparing a formboard for assembly of a wire harness, the formboard having a face and a plurality of holes through the face, wherein the method comprises:

providing a plurality of layout sheets, each layout sheet having a harness pattern thereon, a plurality of holes corresponding to holes in the formboard, a free edge, and an opposing attached edge that is attached to the formboard, wherein the attached edges of the layout sheets are aligned with and stacked upon one another;

selecting one of the layout sheets for wire harness assembly, the thus selected layout sheet lying over the face of the formboard with its harness pattern exposed, and the other unselected layout sheets comprising either or both of (i) at least one layout sheet under the selected layout sheet, and (ii) at least one layout sheet folded back from the selected layout sheet along the attached edge thereof; and inserting a plurality of guide pins through respective holes in the selected layout sheet adjacent to its harness pattern, through respective holes in any unselected layout sheet under the selected layout sheet, and into holes in the formboard, corresponding to said respective holes in the selected layout sheet and any unselected layout sheet thereunder, so as to be removably secured therein.

16. A method as recited in claim 15 wherein any unselected layout sheet folded back from the selected layout sheet is placed and held in a slotted tube fixedly connected to the formboard adjacent to the attached edges of the layout sheets.

17. A method as recited in claim 15 wherein each pin has a tapered portion and each hole in the formboard is tapered so that insertion of the tapered portion of a pin into a tapered hole removably secures the pin in the hole.

18. A method as recited in claim 15 wherein the attached edges and free edges of the layout sheets are oriented as upper and lower edges, respectively, and wherein the formboard is selectively moved upwardly or downwardly upon a frame by means of a motor mounted to the frame and a mechanical linkage between the motor and formboard.

19. A method as recited in claim 15 wherein the formboard is comprised of a plastic and each pin is comprised of a metal.

20. A method as recited in claim 19 wherein the plastic is polypropylene and the metal is aluminum.

* * * * *